United States Patent [19]

Honick

[11] 4,144,779

[45] Mar. 20, 1979

[54] PIPE WRENCH

[76] Inventor: Cecil W. Honick, 4008 W. Ave. 43, Los Angeles, Calif. 90041

[21] Appl. No.: 845,375

[22] Filed: Oct. 25, 1977

Related U.S. Application Data

[63] Continuation-in-part of Ser. No. 704,110, Jul. 9, 1976, abandoned.

[51] Int. Cl.[2] ..... B25B 13/28

[52] U.S. Cl. ..... 81/103; 81/145

[58] Field of Search ..... 81/103, 145

[56] References Cited

U.S. PATENT DOCUMENTS

| | | | |
|---|---|---|---|
| 793,551 | 6/1905 | Swengel | 81/103 |
| 843,969 | 2/1907 | Shaver | 81/145 |
| 1,380,566 | 6/1921 | Kiefer | 81/103 |
| 3,996,820 | 12/1976 | Tuell | 81/145 |

*Primary Examiner*—James L. Jones, Jr.
*Assistant Examiner*—James G. Smith
*Attorney, Agent, or Firm*—Lawrence Fleming

[57] ABSTRACT

A pipe wrench which is locked in adjustment by engagement of rack-like teeth on the stem portion of the movable jaw with similar teeth on a slidable member carried in a wide groove in a rocking sleeve. The wrench is adjustable with one hand by squeezing the sleeve and slider to disengage the teeth, then moving the jaw stem via a spur engageable with the finger. The major parts of the sleeve and slider may be made of welded steel stampings.

5 Claims, 5 Drawing Figures

FIG. 1.
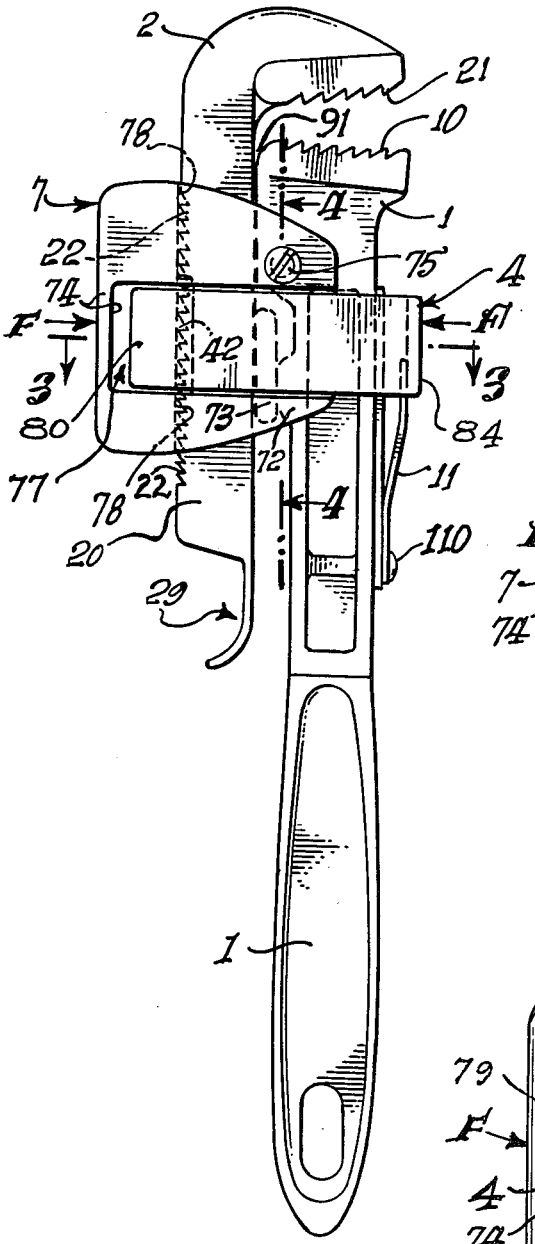
FIG. 2.
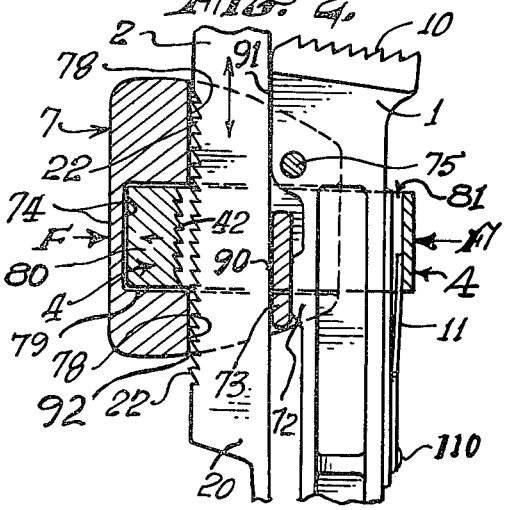
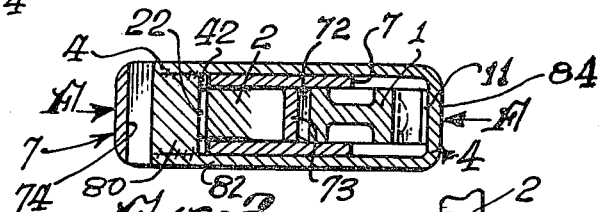
FIG. 3.
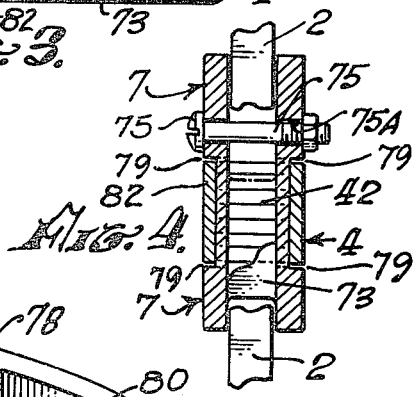
FIG. 4.
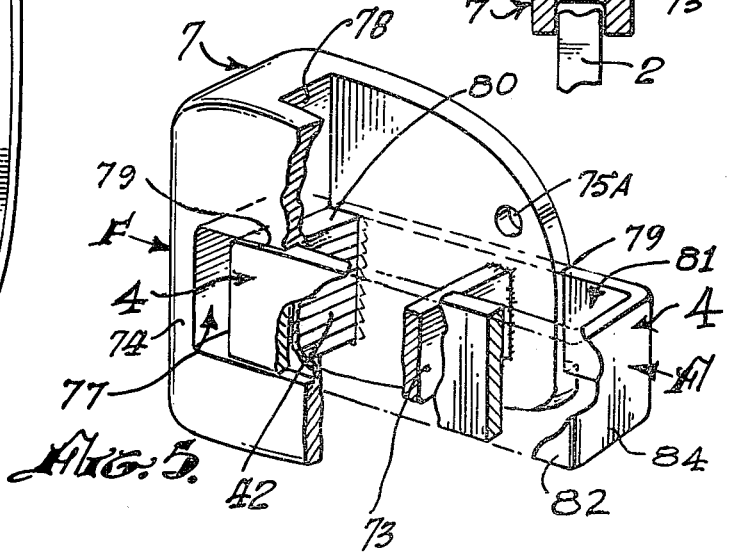
FIG. 5.

PIPE WRENCH

REFERENCE TO PRIOR APPLICATION

This is a continuation-in-part of my prior application Ser. No. 704,110, filed July 9, 1976 now abandoned.

BACKGROUND — FIELD

Nut-adjusted pipe wrenches tend to lose adjustment during use and require frequent resetting. Positive-lock wrenches with disengageable rack-like teeth locking sliding stem have been described, but in forms which appear to need further improvement.

BACKGROUND — PRIOR ART

U.S. Pat. No. 1,380,566 to Kiefer shows a rack-type wrench locked by a sliding toothed "keeper" supported partly by a rocking sleeve and partly by a frame pivot. U.S. Pat. Nos. 793,551 to Swengel and U.S. Pat. No. 1,999,076 to Baumann et al show locking by a pivoted pawl and a lever-actuated toothed block.

BRIEF SUMMARY

In this wrench, the movable upper jaw has a stem-like portion with teeth engaged for locking by internal teeth on a spring-loaded slider, which is confined in wide grooves along the sides of a rocking sleeve. The wrench is adjusted by pushing the slider back to disengage the mating teeth, then moving the outer jaw manually to provide the desired opening of the jaws.

The slider extends forward out of the sleeve and beyond the handle in a box-like shape, closed with a strap portion. Thumb and finger pressure on a sleeve "bridge" portion and the protruding slider strap portion will, by squeezing, move the slider back to disengage the teeth. A spur on the movable jaw stem may then be engaged by the third or fourth finger of the same hand to move the jaw up and down.

The rocking sleeve is pivoted to the handle below the rear portion of the stationary jaw. The slider slides in broad grooves in the sides of the sleeve, which are its sole guide and support, so that its effective pivot point is identical with the sleeve pivot. The movable jaw stem slides snugly between a cross-member inside the sleeve and a pair of spaced inner rear surfaces at the back of the sleeve, to facilitate adjustment.

A single compression spring, which may be a flat spring, is positioned to both bias the pivoting of the sleeve and to urge the rack-like teeth into engagement to lock the setting of the jaws.

IN THE DRAWING

FIG. 1 is a side view of a complete pipe wrench according to the invention, shown in the locked position;

FIG. 2 is a sectional side view of the rocking sleeve portion of the wrench, shown in the disengaged position;

FIG. 3 is a sectional view on line 3—3 of FIG. 1;

FIG. 4 is a sectional view on line 4—4 of FIG. 1; and

FIG. 5 is a partial cuataway perspective view of the rocking sleeve and slider.

DETAILED DESCRIPTION

In FIG. 1 the handle of a wrench according to the invention is shown at 1, and the stationary toothed jaw, integral with the handle 1 or semi-permanently attached to it, is shown at 10. A movable toothed jaw 21 has a semi-permanently attached or integral stem portion 2, 20 which extends downward through a rocking sleeve assembly 7. The back edge of the movable jaw stem portion 2 is provided at 22 with rack-like teeth.

A slider 4, FIGS. 1–5, has internal teeth 42 which releasably engage the teeth 22 on the jaw stem, in order to lock the jaw 21 at a desired opening. In FIG. 1, the teeth are shown in the engaged or locked position. This slider 4 is carried in shallow wide groove portions 79 of the rocking sleeve 7. This sleeve 7 is pivoted to the stationary jaw portion 1 at 75, FIGS. 1, 2, 4 and 5. Pivot pin 75 passes through holes 75A in sleeve 7, FIGS. 4 and 5. It will be apparent that when the movable jaw 2, 21 is locked to the collar 7 by the engagement of the teeth 22, 42, the jaw 2, 21 will be in effect pivoted to the fixed jaw 10 and handle 1 at the same point 75, in the manner of a conventional pipe wrench. Torque on the handle 1 will rock the sleeve 7 slightly in a direction to tighten the jaws on the workpiece. Torque in the opposite direction will loosen the jaws slightly; the degree of such opening is limited by the bearing or butting engagement of a cross-member 73 in sleeve 7 against a protruding portion or boss 72 on the handle 1, FIGS. 1, 2, 3. Cross-member 73 is also shown in FIG. 5.

The back surface of sleeve 7 is continuous. There is a clearance space 77, FIGS. 1 and 5, back of the slider 4 which leaves space for the rear toothed portion or block 80 of the slider 4 when the teeth 22, 42 are disengaged. This space 77 is bridged by a bridge portion of the back of the sleeve at 74, FIGS. 1–3 and 5. To disengage the slider teeth 42 from the jaw stem teeth 22, the operator may merely apply squeezing pressure with thumb and finger at the opposite points F—F, FIGS. 1, 2 and 5. The third or fourth finger of the same hand may then engage the spur 29 on the movable jaw stem 20 and slide the stem up or down until the jaws fit the pipe. The squeezing pressure at F—F is then released, and the wrench is ready for use, and will maintain its adjustment during use. The right-hand end portion of the slider is closed by an integral front strap portion 84, FIGS. 1, 3 and 5, which the right-hand squeezing pressure point F operates to slide back.

The following features further facilitate adjustment of the wrench. Sleeve 7 has a pair of smooth, flat, extended inner surfaces 78, 78 extending above and below grooves 79 and clearance space 77, FIGS. 1, 2, 5, along which the stem teeth 22 bear slidably when slider teeth 42 are disengaged. Cross-member 73 in sleeve 7 is located so as to bear slidably against the smooth front surface of stem 20, in line with the vertical back portion of stationary jaw 1. The clearance here, indicated at 91 in FIGS. 1 and 2, is small, of the order of 0.1 to 0.5 mm. Hence, when the teeth 22, 42 are disengaged, the stem 20 is guided closely between surfaces 78 and the back of cross-member 73, so that the stem 20 can be slid easily up and down without cocking or catching, as at the ends of surfaces 78.

Squeezing points F—F between thumb and finger moves the slider 4 back against the force of a spring 11, FIGS. 1 and 2. This spring may preferably be a flat cantilever spring as shown, of a type often used on pipe wrenches, with its lower end portion riveted or screwed to handle 1 at 110. It does double duty: when the slider 4 is released, it holds the rack-like teeth 22, 42 in engagement, and it also provides the bias force to keep the movable jaw 21 rocked back on its pivot 75 toward the "open" position. As described above, a stop is provided against this biased rocking action by the butting engagement of a transverse cross-member 73 in sleeve 7 against a protruding boss 72 on the back of handle 1, FIGS. 1, 2 and 3. The cross-member 73 is also shown in FIG. 5. It is preferably welded in place.

It will be apparent that when the wrench is tightened around a pipe or the like and torque applied, the torque acts to further compress the spring 11 and to force the teeth 22, 42 into tighter engagement. Hence, the spring 11 need not be particularly stiff. A force requirement of 1 or 1.5 kilograms to disengage the teeth is found satisfactory in practice.

The rocking sleeve 7 is generally in the shape of a "U" (except for cross-member 73), having its open end partially embracing the handle 1, FIGS. 1, 3, 5. For simplicity of illustration, it is shown as being made in one piece; but it may preferably be fabricated from three or four pieces of sheet steel about 2.5 mm thick suitably stamped out and bent and welded or riveted together in known manner. Referring to FIGS. 4 and 5, a portion of each side of the sleeve 7 is thinned or cut away (or may be of one thickness of sheet metal while the adjacent portions are of two thicknesses) to provide groove portions 79. The side portions of slider 4 fit slidably into these groove portions 79. The outer side surfaces of slider 4 may lay approximately flush with the adjacent portions of the sleeve 7, as shown best in FIG. 4.

Slider 4 may be made of a U-shaped bent strip of about 2.5 mm steel 82, as shown best in FIG. 5, its open ends welded, FIG. 4, at the back portion to a separate block-like piece of steel 80 which has cut into it the teeth 42. The slider 4 is thus box-like in shape in the structural sense. Closed front portion 84, FIGS. 3 and 5, is herein termed a front strap.

Rocking sleeve 7 is also generally a box-like structure, because its basic U-like configuration is partly closed by the cross-member 73. Thus, both the rocking sleeve 7 and the slider 4 are structural shapes which are inherently stiff and strong.

It will be apparent that forces due to torque applied to the wrench handle 1 will be borne by bearing pressure of the narrow edges of slider 4 against the edges of the grooves 79 of the rocking sleeve 7. Such forces are in the stiff directions of the side portions of slider 4 and sleeve 7, when these portions are considered as beams.

Referring back to slider 4, FIGS. 2 and 5, closed end portion or front strap of the "U" (whose open end, at the rear, is closed by slider block 80) defines three sides of a partially-enclosed space 81 whose fourth side is bounded by the right-hand or front surface of the handle 1, FIGS. 2 and 5. It is into this space 81 that the spring 11 intrudes.

Referring again to the rocking sleeve 7, the base or closed end portion of the above-mentioned "U" shape appears at the left-hand portions of FIGS. 1, 2, 3 and 5 and is made thick enough to receive the block portion 80 of slider 4. This closed end portion has the smooth, flat, extended inner surfaces 78 which bear slidably against the back surface of movable jaw stem 2, 20, except for that portion of the jaw stem which is engaged by the teeth 42 on slider 4.

Herein (referring to FIGS. 1 and 2) the term "up" means upward toward jaw 21; "forward" or "front" means to the right; and "back" or "rear" to the left.

I claim:

1. A pipe wrench comprising:

a handle with a stationary lower jaw portion;

a movable upper jaw with a depending stem portion extending downward alongside the back of said handle;

rack-like stem teeth along the rear surface of said stem, the front and side surfaces thereof being substantially smooth;

a sleeve pivoted rockably to a jaw-adjacent wide portion of said handle at a single pivot point below the rear portion of said lower jaw, said sleeve having:

space for said stem portion to pass slidably through said sleeve, extended rear inner flat surfaces slidably against said stem teeth, a slider block clearance space between said surfaces, a rear bridge portion over said space providing a continuous outer rear surface, an internal cross-member with its rear surface providing a close sliding fit against the front surface of said stem portion, and a wide shallow slider groove along the major portion of each side;

a slider with side portions sliding confined in said grooves and thereby constrained against angular displacement with respect to said sleeve, and further comprising:

a slider block fastened between said side portions at the rear thereof and inside said clearance space and having teeth engagable with said stem teeth to lock said jaws at a desired opening; and a front strap portion connecting said side portions to close the front of said slider and extending beyond and enclosing said stem portion of said handle, said rear bridge and front strap portions lying substantially opposite each other along a line substantially perpendicular to said handle.

2. A wrench as in claim 1, further comprising:

a compression spring disposed between the front surface of said handle and the inner surface of said front strap to urge said slider forward to engage said teeth and to bias said sleeve rockably toward an open position of said upper jaw, finger and thumb squeezing pressure along said line between said bridge portion and said front strap sliding said slider back to disengage said teeth; and a spur on the lower end portion of said stem portion adapted for engagement by another finger, said wrench being fully adjustable with one hand.

3. A wrench as in claim 1, further comprising:

a boss on the back of said handle adapted for butting engagement by the front surfce of said cross-member, said boss and cross-member being so dimensioned that the rear surface of said cross-member and the front surface of said jaw-adjacent wide portion of said handle are substantially vertically aligned when said teeth are engaged.

4. A wrench as in claim 3, wherein:

said side portions and said front strap portion of said slider are formed integrally of sheet metal in the shape of a narrow "U", and said slider block is welded between the open ends of said "U".

5. A wrench as in claim 4, wherein:

the outer surfaces of said side portions of said slider and the outer side surfaces of said sleeve are substantially flush with each other.

* * * * *